US008028522B2

(12) United States Patent
Irmler et al.

(10) Patent No.: US 8,028,522 B2
(45) Date of Patent: Oct. 4, 2011

(54) COOLING SYSTEM FOR A MOTOR VEHICLE

(75) Inventors: Klaus Irmler, Ammerbuch (DE); Ulrich Maucher, Korntal-Münchingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 744 days.

(21) Appl. No.: 12/065,678

(22) PCT Filed: Sep. 6, 2006

(86) PCT No.: PCT/EP2006/008682

§ 371 (c)(1),
(2), (4) Date: Mar. 6, 2008

(87) PCT Pub. No.: WO2007/028591

PCT Pub. Date: Mar. 15, 2007

(65) Prior Publication Data

US 2008/0196679 A1 Aug. 21, 2008

(30) Foreign Application Priority Data

Sep. 6, 2005 (DE) ..... 10 2005 042 396

(51) Int. Cl.

| | |
|---|---|
| ***F02B 29/04*** | (2006.01) |
| ***F02B 33/44*** | (2006.01) |
| ***F02B 33/00*** | (2006.01) |
| ***F01P 7/14*** | (2006.01) |
| ***F01P 1/06*** | (2006.01) |
| ***F01P 11/08*** | (2006.01) |
| ***F02M 25/07*** | (2006.01) |

(52) U.S. Cl. .... 60/599; 60/605.2; 123/563; 123/568.12; 123/41.31; 123/41.1; 123/41.33; 165/41; 165/51

(58) Field of Classification Search ..... 60/599, 60/605.2; 123/559.1–564, 568.12, 568.11, 123/41.31, 41.1, 41.33; 165/41, 51, 164–166, 165/157, 903 D; *F02B 29/04; F02M 25/07; F01P 3/20, 1/00, 3/00, 5/02*

See application file for complete search history.

(56) References Cited

U.S. PATENT DOCUMENTS

| | | | | |
|---|---|---|---|---|
| 3,946,565 | A | 3/1976 | Cutler | 60/599 |
| 4,062,188 | A * | 12/1977 | Cutler et al. | 60/599 |
| 5,036,803 | A | 8/1991 | Nolting et al. | 123/41.1 |
| 5,181,554 | A * | 1/1993 | Mita | 165/41 |
| 5,215,044 | A | 6/1993 | Banzhaf et al. | 123/41.31 |
| 5,706,790 | A * | 1/1998 | Kemmler et al. | 123/564 |
| 6,216,458 | B1 * | 4/2001 | Alger et al. | 60/605.2 |
| 6,247,523 | B1 * | 6/2001 | Shibagaki et al. | 165/51 |

(Continued)

FOREIGN PATENT DOCUMENTS

| | | |
|---|---|---|
| AT | 170662 B | 3/1952 |

(Continued)

*Primary Examiner* — Thai Ba Trieu
(74) *Attorney, Agent, or Firm* — Foley & Lardner LLP

(57) ABSTRACT

The invention relates to a cooling system for a motor vehicle comprising a first heat exchanger (1), in particular, embodied in the form of a main cooler for cooling a first liquid coolant (3) of an internal combustion engine (2) by means of an air flow coming from the ambient air and a second heat exchanger (7, 13, 407, 415) for cooling gases introduceable into the internal combustion engine, in particular, exhaust gases and/or charge air, wherein the second heat exchanger (7, 13, 407, 415) is coolable by the an air flow coming from the ambient air and is spatially separated from the main cooler (1).

24 Claims, 3 Drawing Sheets

U.S. PATENT DOCUMENTS

| | | | | |
|---|---|---|---|---|
| 6,569,550 | B2 | 5/2003 | Khelifa | 429/13 |
| 6,604,514 | B1 * | 8/2003 | Englund et al. | 123/559.1 |
| 6,910,469 | B2 * | 6/2005 | Renkonen | 123/563 |
| 7,004,154 | B2 | 2/2006 | Joyce et al. | 123/563 |
| 7,032,577 | B2 | 4/2006 | Rosin et al. | 123/568.11 |
| 7,040,303 | B2 * | 5/2006 | Uzkan et al. | 60/599 |
| 7,059,308 | B2 | 6/2006 | Eitel et al. | 123/568.12 |
| 7,168,419 | B2 | 1/2007 | Rosin et al. | 123/568.11 |
| 7,237,604 | B2 * | 7/2007 | Emrich et al. | 165/167 |
| 7,322,193 | B2 * | 1/2008 | Bering et al. | 60/605.2 |
| 7,464,748 | B2 * | 12/2008 | Lee | 123/563 |
| 7,469,689 | B1 * | 12/2008 | Jones et al. | 123/559.1 |
| 7,571,718 | B2 * | 8/2009 | Hendrix et al. | 123/563 |
| 7,591,254 | B2 * | 9/2009 | Machner | 123/559.1 |
| 7,607,301 | B2 * | 10/2009 | Harada et al. | 60/605.2 |
| 7,617,679 | B2 * | 11/2009 | Kardos et al. | 60/599 |
| 2003/0033993 | A1 * | 2/2003 | Valaszkai et al. | 60/599 |
| 2003/0141037 | A1 | 7/2003 | Zobel et al. | 165/41 |
| 2007/0039322 | A1 * | 2/2007 | Bering et al. | 60/599 |
| 2007/0125527 | A1 | 6/2007 | Flik et al. | 165/140 |
| 2008/0098998 | A1 * | 5/2008 | Dicke | 60/599 |
| 2009/0139474 | A1 * | 6/2009 | Mokire | 60/599 |
| 2009/0260775 | A1 * | 10/2009 | Maucher et al. | 165/41 |
| 2010/0095909 | A1 * | 4/2010 | Lin et al. | 123/41.02 |
| 2011/0000469 | A1 * | 1/2011 | Lauberts et al. | 123/564 |

FOREIGN PATENT DOCUMENTS

| | | | | |
|---|---|---|---|---|
| DE | 3508240 | A1 | * | 9/1986 |
| DE | 37 38 412 | A1 | | 5/1989 |
| DE | 41 04 093 | A1 | | 8/1992 |
| DE | 198 08 633 | A1 | | 9/1999 |
| DE | 198 49 619 | A1 | | 5/2000 |
| DE | 199 61 825 | A1 | | 6/2001 |
| DE | 102 03 003 | A1 | | 8/2003 |
| DE | 103 43 756 | A1 | | 4/2004 |
| DE | 103 51 546 | A1 | | 6/2004 |
| DE | 10 2004 001 462 | A1 | | 8/2005 |
| EP | 0 499 071 | A1 | | 8/1992 |
| EP | 1 420 221 | A2 | | 5/2004 |
| FR | 2 283 338 | A1 | | 3/1976 |
| JP | 51050008 | | | 5/1976 |
| JP | 04314918 | A | * | 11/1992 |
| JP | 08158871 | A | * | 6/1996 |
| JP | 2002339810 | A | * | 11/2002 |
| JP | 2006509146 | | | 3/2006 |
| WO | WO 2004/051069 | A1 | | 6/2004 |
| WO | WO 2004065874 | A1 | * | 8/2004 |
| WO | WO 2004/113815 | A1 | | 12/2004 |

* cited by examiner

COOLING SYSTEM FOR A MOTOR VEHICLE

BACKGROUND

The invention relates to a cooling system for a motor vehicle.

Modern motor vehicles already have, on account of increasing levels of engine power and an increasing number of auxiliary units, a high overall thermal output, which requires high cooling capacities in order to dissipate heat by means of heat exchangers. Here, the often limited installation space for a heat exchanger or combination of heat exchangers arranged in the relative wind has in the meantime been completely used up. The possible flow of ambient air is generally improved by means of ever more powerful fans which are usually arranged on the suction side of a main cooler. Overall, the maximum cooling capacity by means of heat exchangers or heat exchanger packs arranged in the relative wind or at the end side of a motor vehicle has been largely exhausted.

This situation clashes with ever stricter emissions standards which are impending in the coming years primarily in Europe and the USA. In order to meet said emissions standards in particular in the case of diesel engines, though fundamentally also in spark-ignition engines and new engine concepts such as for example HCCI, there are numerous proposals to reduce the emissions, in particular of nitrogen oxides, by means of at least partial exhaust-gas recirculation into the combustion tract of the engine. Said exhaust-gas recirculation is only expedient if the exhaust gas is previously cooled. For this purpose, substantially liquid-cooled heat exchangers have been proposed, with the cooling liquid usually being connected to the main cooling circuit of the internal combustion engine. In this way, high levels of thermal output, which can reach up to over 100 kW, are introduced into the main cooling circuit of the internal combustion engine by means of the exhaust-gas recirculation.

In addition, in exhaust-gas recirculation, there is the fundamental problem that the power and pollutant emissions of the engine are all the better the cooler the intake-side gases are. Here, the cooling of the recirculated exhaust gases by means of a liquid heat exchanger arrives at theoretical limits, since at least when using main engine coolant, the temperature of the secondary medium which is to be cooled lies in the region of 100° C.

In addition to the problem of cooling recirculated exhaust gases, there are also increasing problems in cooling charged fresh air. In the meantime, multi-stage charging systems have been developed, with fundamentally the efficiency and power-to-weight ratio of an internal combustion engine being improved by means of high exhaust-gas charging. The high fresh gas temperatures generated during the exhaust-gas charging must however be cooled. In the known arrangements of a charge-air cooler in a structural unit with the main cooler, which is arranged in the relative wind, of a vehicle, the attainable cooling capacity is limited on account of the use of the same air flow of ambient air. Said cooling capacity is ultimately limited by the possibly design-related delimitation of the vehicle end face or of the air inlet cross sections.

DE 102 03 003 A1 describes a cooling system for a motor vehicle in which a part of the exhaust gases of the internal combustion engine are introduced into a charged fresh air flow, with the recirculated exhaust gases first being cooled by means of a liquid heat exchanger which is provided with a bypass. Here, the liquid heat exchanger is connected to the main cooling circuit of the internal combustion engine.

SUMMARY

It is an object of the invention to improve a cooling system for an internal combustion engine with regard to its thermal overall performance.

Said object is achieved, for a cooling system specified in the introduction, according to the invention by means of the characterizing features of claim 1.

The cooling system for a motor vehicle comprises a first heat exchanger, which is arranged substantially in the front of the vehicle and which is embodied in particular as a main cooler, for cooling a coolant, which is in particular liquid and/or gaseous, of an internal combustion engine by means of an air flow of ambient air, and if required additional heat exchangers for cooling or heating further media, and a second cooler which can be cooled by means of an air flow of ambient air. The second cooler is arranged spatially separate from the main cooler, with the air flow for the second cooler and the air flow for the heat exchanger being extracted from the environment spatially separately from one another.

As a result of the additional cooler being arranged spatially separate from the main cooler, it is possible to utilize further air flows for dissipating heat of the internal combustion engine, with the second cooler advantageously serving for directly cooling gases, in particular exhaust gas and/or charge air.

In one advantageous embodiment, the cooling system comprises an air feeding means, by means of which the second cooler can be traversed by an air flow of ambient air, with the air feeding means in particular being an air feeding means which is separate from a main fan of the first heat exchanger. In this way, in particular when the second cooler cannot be effectively traversed by relative wind in its spatial arrangement, a considerable improvement of the possible exchanger power of the second cooler is obtained in particular at low driving speeds.

In one advantageous embodiment, the air feeding means is a radial fan. Radial fans are particularly pressure-resistant and particularly non-critical with regard to the angle of the approaching and outflowing air. Radial fans are therefore very particularly preferable for supplying a second cooler within the context of the invention if the second cooler and/or air intake region is arranged at an unfavorable location in the engine bay, in particular if angled air guidance is necessary in the region of the air feeding means. Radial fans additionally result in a high feed rate in a limited installation space and with relatively low noise generation.

It is however also alternatively possible for an axial fan to be used as an air feeding means.

Regardless of the type of air feeding means, the latter can preferably be arranged upstream of the second cooler (pressure operation) or else downstream of the second cooler (suction operation). In addition, the air feeding means can also be arranged between two coolers.

The air feeding means can preferably be driven by means of an electric motor. Alternatively, and where there is suitable installation space available, the air feeding means can however also be mechanically coupled to the internal combustion engine, in particular via a clutch means. Fundamentally any type of force transmission to the air feeding means is possible, for example also a hydrostatic drive.

The air feeding means is particularly preferably designed such that it can be driven by means of an exhaust-gas turbine. This can be a separate exhaust-gas turbine assigned only to driving the air feeding means.

In one particularly preferred embodiment, the air feeding means can be driven by means of a shaft of an exhaust-gas turbocharger for air charging. Here, the air feeding means can in particular be an impeller which is attached to a projecting journal of the exhaust-gas turbocharger shaft, with a corresponding further housing part being added to the exhaust-gas turbocharger. Here, the exhaust-gas turbocharger can be of modular construction, so that it can also be used as a component without the additional air feeding means in corresponding vehicles, with it being possible for a modified version with an additional air feeding means module to be used in other engines with for example higher emissions limit values or higher power.

It is fundamentally preferably provided that a drive of the air feeding means can be selectively regulated, in particular activated and deactivated. In this way, the energy consumption can be reduced corresponding to the driving situation if no drive of the air feeding means of the second cooler is necessary.

In a further preferred embodiment of a cooling system according to the invention, a third cooler is provided which is traversed by the gas which can be supplied to the internal combustion engine, with it being possible for the gas to be cooled in the third cooler by means of a liquid medium, in particular a coolant of the internal combustion engine. In this way, two-stage or multi-stage cooling of the gaseous primary medium is realized overall, with it being particularly preferable for a first cooling stage to be formed by the liquid-operated third cooler and a second cooling stage to be formed by the second cooler, around which air flows. As a result of said adaptation of the coolant temperature (liquid generally in the region of 100° C. at the first stage, ambient air typically in the region of 20° C. at the second stage), particularly effective cooling of the gas is possible, with a considerable part of the thermal energy of the gas additionally not being introduced into the cooling system of the internal combustion engine but being dissipated directly to the environment (direct cooling by means of the second stage).

In one preferred embodiment, the second cooler is traversed by an exhaust-gas flow which is recirculated to the internal combustion engine. Depending on the design of the cooling system, the second cooler can be a low-pressure exhaust-gas cooler in which the exhaust gas which is conducted into the cooler is extracted downstream of a final stage of an exhaust-gas turbocharger system.

The second cooler can however also be traversed by a flow of charged fresh air which is conducted to the internal combustion engine, or in a further alternative embodiment, by a mixture of charged fresh air and exhaust gas which are conducted to the internal combustion engine.

With regard to the preferred design of the second cooler, the latter is advantageously a parallel-flow cooler, in particular a counterflow cooler. The parallel flow arrangement serves to take into consideration the fact that, in the majority of cases, the second cooler must be accommodated in a limited and if appropriate unfavorably-shaped installation space. The counterflow arrangement is particularly advantageous with regard to the cooling capacity. The second cooler can be designed in particular as a tri-flow cooler in which three ports for the secondary medium which is to be cooled are provided, which leads to a particularly good combination of cooling capacity and temperature distribution in the material of the cooler. In general, the second cooler can also be an at least two-path cooler, as a result of which the cooling capacity can be improved with given cooler dimensions and with a sufficient available cooling air flow.

With suitable conditions in particular with regard to the installation space, the second cooler can however also be a cross-flow cooler.

In a further preferred embodiment of a cooling system according to the invention, a further air-cooled cooler is provided, with the second cooler being designed to cool one of the two, exhaust gas or fresh charge air, and a further cooler being designed to cool the respective other of the two. Here, it is possible in particular for the two air-cooled coolers to be spatially separate from a main cooler of the vehicle, though it is also possible for only one of the two air-cooled coolers to be arranged spatially separate from the main cooler. Here, in a preferred refinement, a flow of ambient air can be fed by means of a common air feeding means both to the second cooler and also to a further cooler. This can be realized for example in that the second cooler and the further cooler are arranged adjacent to one another. This can however also involve a non-adjacent arrangement with correspondingly branched air guiding ducts, with the common air feeding means driving the ambient air through both air ducts in pressure operation.

It can generally preferably be provided that the air flow assigned to the second cooler and/or to the one further cooler can be varied in magnitude by means of a valve means, in particular an adjustable flap. In this way, the cooling capacity of the second cooler can be adapted to the respective demands in a simple manner, with an adaptation being possible in the adjustable flap even when the air flow is caused by relative wind.

A variable branch, in particular a bypass, can preferably be provided upstream of the second cooler in a guide of the gas which is to be cooled. In this way, it is taken into consideration that in particular air-cooled gas coolers can ice up at low external temperatures, wherein frozen water condensed out of the conducted gases, in particular in the case of conducted exhaust gases, can reduce or prevent the passage of the primary medium through the cooler. The variable branch can be either a bypass or simply an opening by means of which built-up exhaust gas can be blown out into the environment. Here, the variability of the branch can consist in an overpressure flap or else in a regulable flap. The arrangement is advantageously formed such that, as a result of the gas being blown out or being conducted through the bypass, the heat exchanger is heated in order to melt the frozen condensed water.

It is generally provided in one advantageous embodiment that the outflowing cooling air of the second cooler can be supplied at least at times to a vehicle interior space for the purposes of heating. For this purpose, it is for example possible for the cooling air flowing out of the second cooler to be supplied via a duct into an inlet region of a ventilation or air-conditioning system of the vehicle. The supply of the heated waste air can for example be regulated by means of an adjusting flap. A considerable advantage of such a utilization of the heated cooling air is in a particularly fast response of the vehicle heating in the event of a cold start of the engine. In addition, the second cooler will often be arranged in a lateral or rear region of the engine bay, resulting in a better capability for connecting the waste air flow to the ventilation system than exists for the main cooler.

In order to ensure a sufficiently low cooling air temperature for the second cooler, it is generally advantageously provided that an intake of ambient air for cooling the second cooler takes place outside the engine bay. Here, it is possible in particular for an intake to be provided in the region of a wheel arch.

Further advantages and features can be gathered from the exemplary embodiments described below and from the dependent claims.

BRIEF DESCRIPTION OF THE DRAWINGS

Below, four preferred exemplary embodiments of a cooling system according to the invention are described and explained in more detail on the basis of the appended drawings.

DELAILED DESCRIPTION

Figure 1:
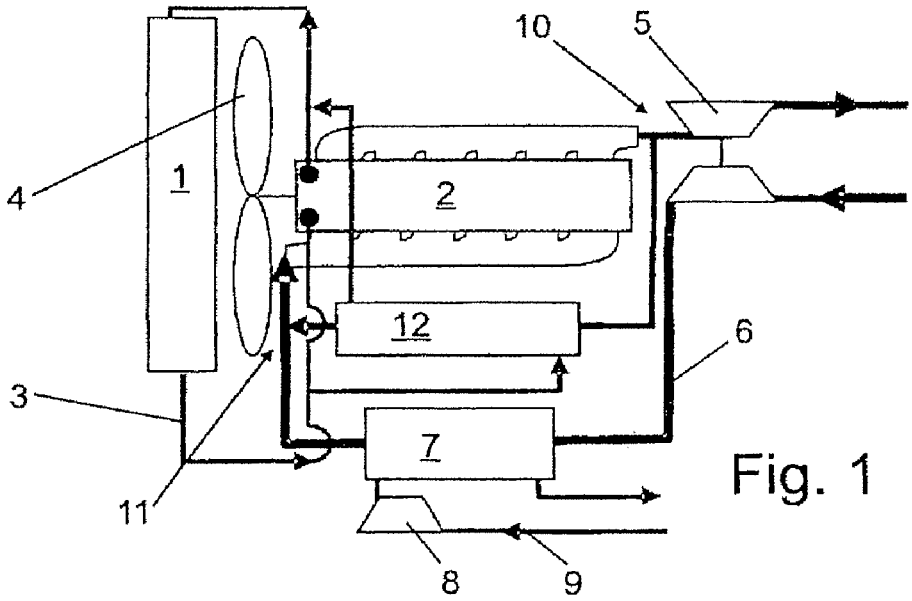
FIG. 1 shows a schematic illustration of a first exemplary embodiment of a cooling system according to the invention.

The cooling system according to the invention as per FIG. 1 (first exemplary embodiment) comprises a main cooler 1 of an internal combustion engine 2, which main cooler 1 cools the internal combustion engine 2 in a manner known per se by means of a liquid coolant in a closed cooling circuit 3. Here, the main cooler 1 is arranged in the end region of the vehicle and is at least largely traversed by relative wind. In addition, a main fan 4 is provided in a suction arrangement on the main cooler 1, by means of which main fan 4 a sufficient flow of air through the main cooler is ensured even at low speeds.

The internal combustion engine 2 has charging of its supplied fresh gas 6 by means of an exhaust-gas turbocharger 5, with it being necessary to cool the charged fresh air 6 before being supplied to the internal combustion engine 2 on account of the heating generated in the exhaust-gas turbocharger 5. For this purpose, a charge-air cooler 7 is provided which is spatially separate from the main cooler 1, which charge-air cooler 7 is a second cooler within the context of the invention. The charge-air cooler 7 is traversed by ambient air 9 by means of an air feeding means 8 which is embodied as an electric fan, as a result of which direct cooling of the charge air 6 in an open circuit is provided. It can also be seen from the spatial arrangement of the components in FIG. 1 that the charge-air cooler 7 and the air feeding means 8 are not arranged in the end region of the vehicle but rather in a lateral engine bay region. On account of the arrangement outside the relative wind region, the air feeding means 8 is often in operation when the charge-air cooler 7 must be operated with sufficient cooling capacity.

In addition, partial exhaust-gas recirculation is provided by means of a branch 10 in the exhaust-gas line of the internal combustion engine 2, with the exhaust gas being merged with the charged fresh air at an interface 11 which can be regulated by means of a valve (not illustrated). The recirculated exhaust gas is cooled in a third cooler 12 before the merging in the region 10. The third cooler 12 is arranged in the main cooling circuit parallel to the internal combustion engine 2, so that the dissipated heat of the exhaust gas is finally introduced via the liquid-cooled third cooler 12 into the main coolant of the internal combustion engine 2.

For an engine design with increased engine power or higher exhaust-gas recirculation rates, when considering the heat balance, the heat flows in the cooling system of the internal combustion engine 2 are such that, on account of the exhaust-gas recirculation, less heat energy is given out by means of the exhaust gas, or in the internal combustion engine, more heat energy is introduced into the coolant. The heat quantity which is thus additionally introduced into the coolant is dissipated by means of a main cooler which is designed to be larger than usual. As a result of the larger design of the main cooler 1, a combination, as is known per se, of the main cooler with a charge-air cooler to form a structural unit is no longer possible or expedient in terms of cooling capacity. The charge-air cooler 7 is therefore arranged separately and supplied with ambient air which is driven by an air feeding means 8. Considered very approximately, it could therefore be stated that, with maximum utilization of the cooling capability in the end region of a vehicle, the heat balance as per the exemplary embodiment according to the invention is such that the heat quantity which is extracted from the exhaust gas is additionally dissipated to the ambient air substantially via the charge-air cooler 7.

Figure 2:
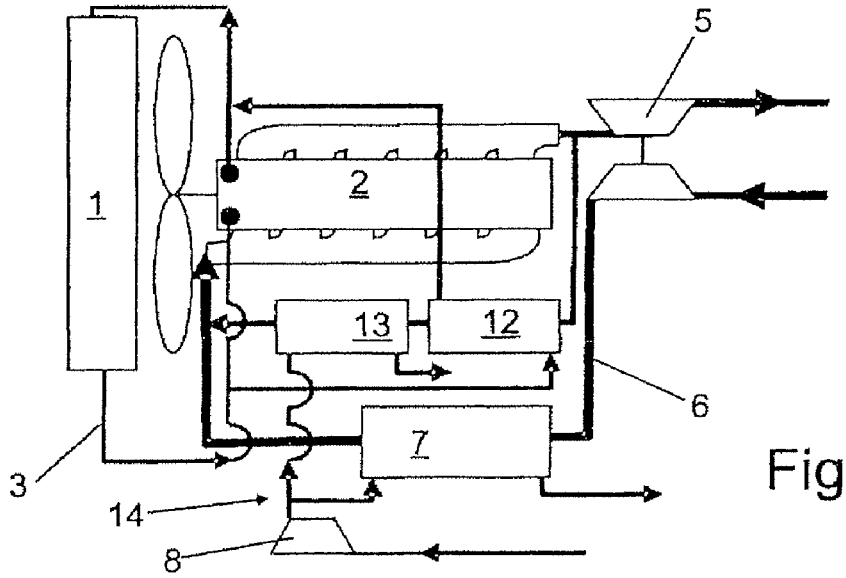
FIG. 2 shows a schematic illustration of a second exemplary embodiment of a cooling system according to the invention.

The second exemplary embodiment as per FIG. 2 differs from the first exemplary embodiment primarily in that a further exhaust-gas cooler 13 around which ambient air flows and which is spatially separate from the main cooler 1 is provided, which further exhaust-gas cooler 13 is arranged downstream of the liquid-cooled first exhaust-gas cooler (or third cooler) 12 as viewed in the flow direction of the recirculated exhaust gas. This is expedient with regard to the cooling of the exhaust gas since the ambient air temperature is often below the coolant temperature.

With regard to the supply of ambient air to the additional exhaust-gas cooler 13, a branch 14 is provided in the fresh air flow 9, which branch 14 is arranged downstream of the air feeding means 8 which is operated in a pressure arrangement. In the physical embodiment, it can be provided here depending on requirements that the exhaust-gas cooler 13 and the charge-air cooler 7 are arranged directly adjacent and that the same fresh air flow flows around them, or that said exhaust-gas cooler 13 and charge-air cooler 7 are arranged spatially separately, for which purpose air guiding ducts, which are usually separate after the branch 14, are provided for conducting the fresh air to the respective coolers 7, 13.

With regard to the heat balance as per the cooling system of the second exemplary embodiment, it can be stated that the main cooler, as in the first exemplary embodiment, is of particularly large design in order to dissipate the additional heat quantity which is introduced by means of the liquid-cooled exhaust-gas cooler 12 into the circuit of the internal combustion engine 2, with a quantity of heat additionally being dissipated directly to the environment both from the charge-air cooler 307 around which air flows, and also from the exhaust-gas cooler 13 around which air flows.

Figure 3:
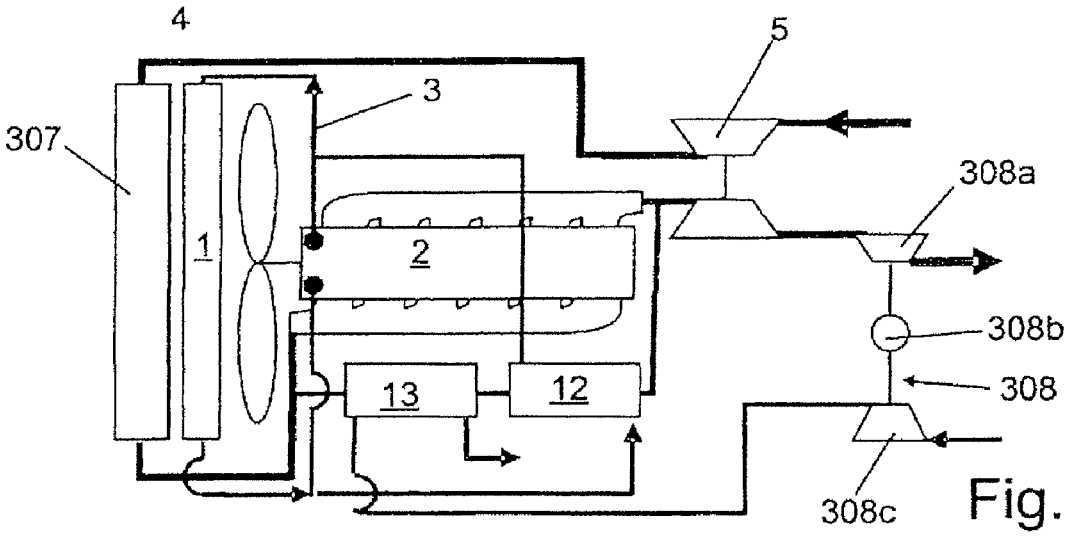
FIG. 3 shows a schematic illustration of a third exemplary embodiment of a cooling system according to the invention.

The cooling system as per the third preferred exemplary embodiment (FIG. 3) has a charge-air cooler 307 which, in contrast to the first and second exemplary embodiments, is not arranged spatially separate from the main cooler 1 but rather is, in a manner known per se, combined with said main cooler 1 to form a structural unit. In this way, relative wind flows around the charge-air cooler 307 as well as around the main cooler 1, and this therefore entails a reduction in the possible cooling capacity of the main cooler 1.

As in the case of the second exemplary embodiment, two-stage cooling of the recirculated exhaust gas is provided, with the first stage likewise being obtained by means of a third cooler 12 and the second stage by means of an air-cooled heat exchanger 13. Pumped fresh air flows around the heat exchanger 13, with a feeding means 308 for the ambient air or fresh air being provided.

One peculiarity is in the feeding means 308 which in the present case has, as a drive, a separate exhaust-gas turbine 308*a* which can be designed so as to be detachably connectable by means of a clutch 308*b* to an impeller 308*c*. In a preferred modification, the impeller 308*c* can however also be seated directly on a shaft of the exhaust-gas turbocharger 5 in order to save on components and installation space. For this purpose, the exhaust-gas turbocharger has a module-like further housing part in order to form the air feeding means (not illustrated).

Figure 4:
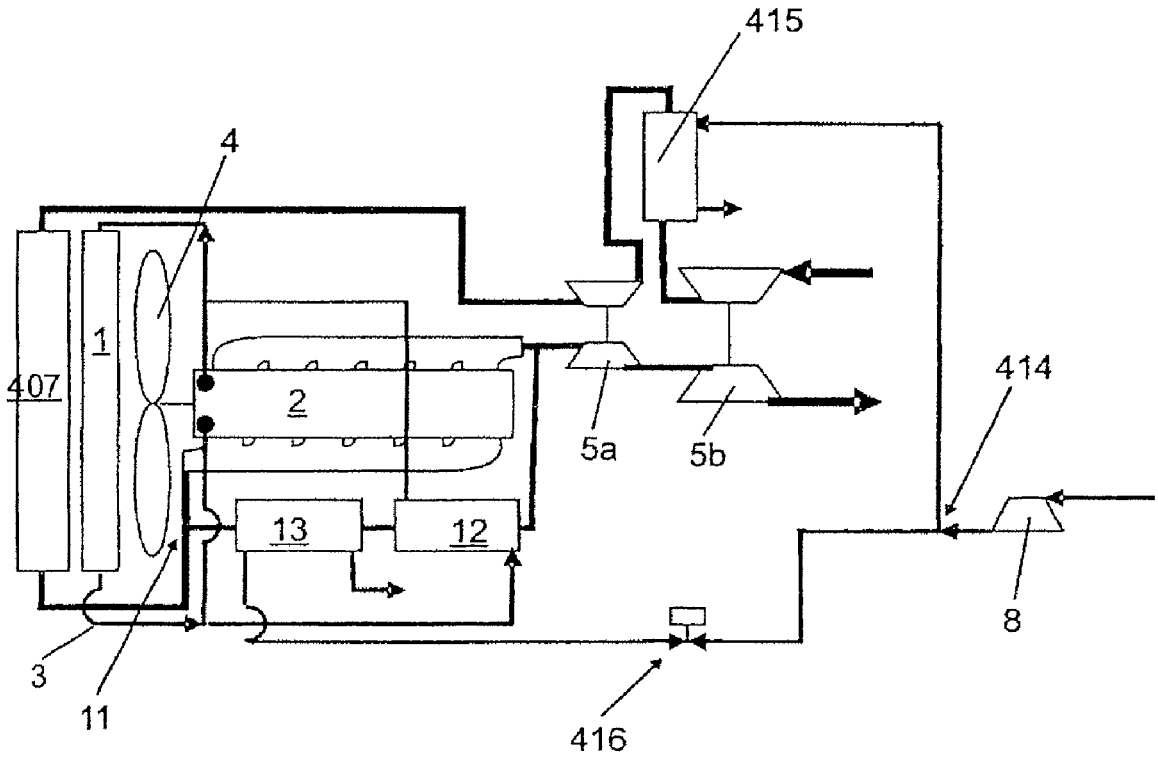
FIG. 4 shows a schematic illustration of a fourth exemplary embodiment of a cooling system according to the invention.

The cooling system as per a fourth preferred exemplary embodiment (FIG. 4) has similarities to that of the third exemplary embodiment. In contrast, however, two-stage charging of the internal combustion engine 2 is provided by means of a first exhaust-gas turbocharger 5*a* and a second exhaust-gas turbocharger 5*b*, which are arranged one behind the other in series. Provided downstream of a first charging stage of the fresh air by means of the second exhaust-gas turbocharger 5*b* is an intermediate cooler 415 around which air flows and which cools down the pre-cooled charge air before it enters into the compressor stage of the first exhaust-gas turbocharger 5*a* and is finally compressed there. Here, the intermediate cooler 415 can serve as a "second cooler" or as a "further cooler" within the context of the invention. After the final compression, the compressed charge air flows through the main charge-air cooler 407 which is known in principle from the third exemplary embodiment and which is joined to the main cooler 1 to form a structural unit, downstream of which, at an interface 11, recirculated exhaust gas is supplied to the finally-compressed and cooled charge air. The recirculated exhaust gas is, as in the third exemplary embodiment, cooled in two stages by means of a liquid-cooled second cooler 12 and an air-cooled cooler 13. Overall, in the fourth exemplary embodiment, there are therefore two air-cooled gas coolers 415, 13 which are arranged in the engine bay spatially separate from the main cooler 1 and from the main charge-air cooler 407. In order to provide said two coolers 415, 13 with cooled ambient air, an electrically driven air feeding means 8 which is embodied as a radial fan is provided which, in a pressure arrangement, presses air through a branch 414, by means of which the cooling air is distributed between the two coolers 13, 415. An adjustable valve or an actuating flap 416 is additionally provided in the inlet duct to the cooler 13. By regulating said actuating flap 416, it is possible for the cooling air flow to be divided in a regulated fashion between the two coolers 13, 415. In this way, it is possible for the cooling system to be optimized depending on the operating state. In the fourth exemplary embodiment, a total of four coolers 1, 3, 407, 415 are therefore provided which bring about direct open cooling with ambient air and therefore dissipate heat generated by the internal combustion engine 2 into the environment.

Regardless of the exemplary embodiments as per FIG. 1 to FIG. 4, FIG. 5 to FIG. 8 show exemplary schematic designs of heat exchangers which are particularly suitable in terms of their construction for a second cooler or else a further cooler according to the invention.

Figure 5:
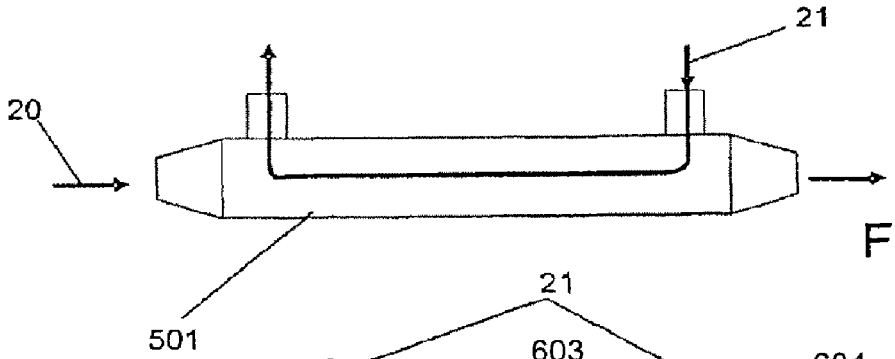
FIG. 5 shows a schematic illustration of a heat exchanger which is operated in counterflow and is traversed by flow in parallel.

Here, FIG. 5 shows a heat exchanger 501 which is traversed by flow in parallel and which is operated in counterflow and which is traversed in one direction by a primary medium 20 and, in a separate chamber, is traversed in the opposite direction by a cooling air flow 21 (secondary medium).

Figure 6:
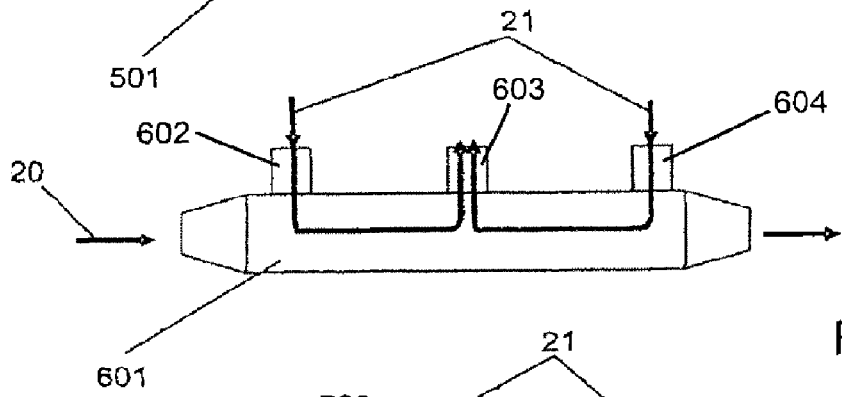
FIG. 6 shows a schematic illustration of a tri-flow cooler.
Figure 7:
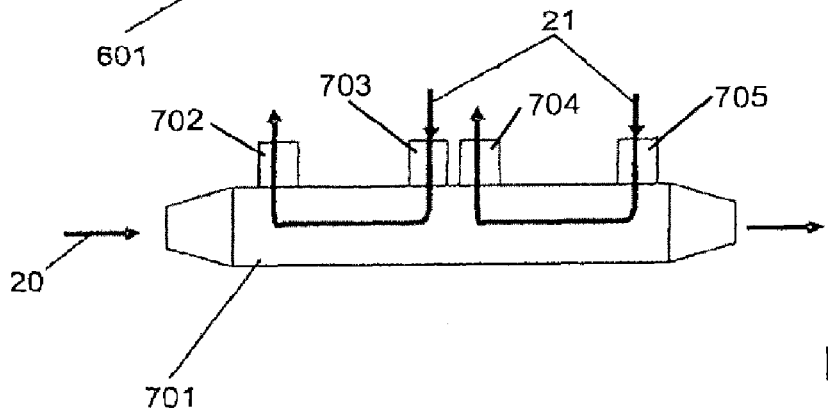
FIG. 7 shows a schematic illustration of a 2-path cooler.

FIG. 6 shows a tri-flow cooler 601 which is traversed in one direction by the primary medium 20 which is to be cooled. With a total of three connecting pipes 602, 603, 604, cooling air is conducted in at the two end-side pipes 602, 604 and is discharged through the central connecting pipe 603. In a first section of the tri-flow cooler 601, the cooling air therefore flows in the same direction as the primary medium, and in the subsequent second section, in the opposite direction to the primary medium. In this way, the cooling power can, with a sufficient available quantity of cooling air 21 and for given installation dimensions, be significantly increased, with uniform heating of the cooler 601 also being given.

Similarly to the tri-flow cooler, the cooling capacity can be optimized by means of a two-path cooler 701 (see FIG. 7), with the cooling air 21 flowing in and out via in each case four ports 702, 703, 704, 705 provided on the cooler, with two cooling paths which are operated counter to the flow direction being provided sequentially along the path of the primary medium 20.

Figure 8:
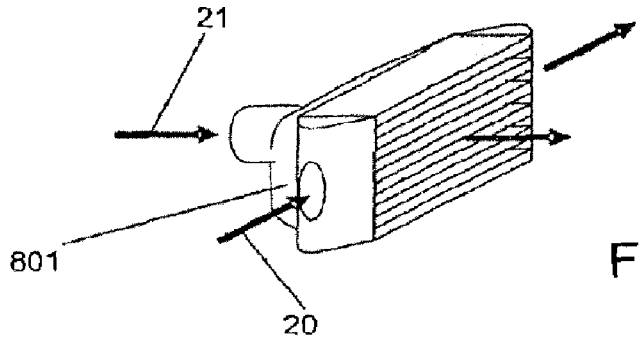
FIG. 8 shows a schematic illustration of a cross-flow cooler.

FIG. 8 shows a cross-flow cooler in which primary medium 20 and cooling air 21 flow substantially at right-angles to one another. A cross-flow cooler 801 is simple to produce and is effective if the required installation space is available.

A second cooler within the context of the invention can, in terms of construction, have a tube bundle design, in particular with air-cooled fins. Said construction can also be a plate design with an axial throughflow of the primary gas, in particular with fins at both sides, in particular with a surrounding housing. Alternatively, a second cooler can have a plate design in which the primary medium approaches the plates transversely; fins can also be provided here. Both the primary side and also the secondary side can in each case be designed with turbulence generators (winglets) or else with internal fins.

In very general terms, it can be provided in all of the described exemplary embodiments that the fresh air heated by the cooling process is not dissipated to the environment or is dissipated to the environment only to a small degree and is used for heating the interior space of the vehicle. This can take place by means of admixing or by means of a heat exchanger. Cooling air ducts (not shown) and regulating flaps can serve for this purpose in a simple manner.

Since, by means of a cooling system according to the invention, heat exchangers are moved away from the front of the vehicle, it is also possible for the space which is possibly freed up to be particularly expediently utilized for implementing an additional low-temperature coolant circuit in addition to the main coolant circuit, with a second coolant cooler arranged largely upstream of the main coolant cooler at the vehicle end side. Similarly, instead of a low-temperature coolant circuit, it is also possible to provide a coolant circuit in which, instead of the second coolant cooler, a condenser is arranged largely upstream of the coolant cooler.

All the components and arrangements specified in particular also in the exemplary embodiments can be combined in any desired form. This applies in particular to the type and design of heat exchangers, of air feed elements, clutch elements, valves, bypass tubes and outlets of the cooling air into the environment, which can in each case be integrated into the cooling system in different arrangements and numbers.

Since the cooling air can be heated up considerably, it is possible to provide measures at the outlet of the cooling air into the environment in order to prevent the impermissible heating of other vehicle components or to prevent the risk to persons, in particular also passers-by. This can take place by means of suitable positioning of the outlet, in particular for example above the driver's cabin. A discharge of the cooling air via the exhaust pipe can also be advantageous. In a further advantageous embodiment, the cooling air can be mixed with ambient air, and thereby cooled, at the outlet. Here, intense turbulence generation of the cooling air at the outlet can be particularly expedient; mention is made here in particular of imparting an intense swirl, which particularly effectively leads to the break-up of the emerging gas jet and therefore to efficient mixture with ambient air.

The invention claimed is:

1. A cooling system for a motor vehicle, comprising:

a main cooler arranged substantially in a front of the motor vehicle and configured to cool a liquid coolant to be supplied to an internal combustion engine, wherein the liquid coolant is cooled by a first flow of ambient air;

a second cooler configured to cool a flow of gas to be supplied to the internal combustion engine, wherein the flow of gas is cooled by a second flow of ambient air;

a main fan configured to provide at least a portion of the first flow of ambient air; and an air feeder configured to provide at least a portion of the second flow of ambient air, wherein the second cooler is separate from the main cooler, wherein the air feeder is separate from the main fan, wherein the first flow of ambient air and the second flow of ambient air are extracted from the environment at different locations.

2. The cooling system as claimed in claim 1, wherein the air feeder is a radial fan.

3. The cooling system as claimed in claim 1, wherein the air feeder is an axial fan.

4. The cooling system as claimed in claim 1, wherein the air feeder is driven by an electric motor.

5. The cooling system as claimed in claim 1, wherein the air feeder is mechanically coupled to the internal combustion engine.

6. The cooling system as claimed in claim 1, wherein the air feeder is driven by an exhaust-gas turbine.

7. The cooling system as claimed in claim 1, wherein the air feeder is driven by a shaft of an exhaust-gas turbocharger.

8. The cooling system as claimed in claim 1, wherein the air feeder is configured to be selectively activated and deactivated.

9. The cooling system as claimed in claim 1, wherein a third cooler is provided which is traversed by the flow of gas supplied to the internal combustion engine, and wherein the gas is cooled in the third cooler by the liquid coolant supplied to the internal combustion engine.

10. The cooling system as claimed in claim 1, wherein the flow of gas is a flow of exhaust-gas.

11. The cooling system as claimed in claim 10, further comprising:

an exhaust gas turbocharger, wherein the second cooler is a low-pressure exhaust-gas cooler, and wherein the second cooler is arranged downstream of the exhaust gas turbocharger.

12. The cooling system as claimed in claim 1, wherein the flow of gas is a flow of charged fresh air.

13. The cooling system as claimed in claim 1, wherein the flow of gas is a flow of a mixture of charged fresh air and exhaust gas.

14. The cooling system as claimed in claim 1, wherein the second cooler is a parallel-flow cooler.

15. The cooling system as claimed in claim 1, wherein the second cooler is a tri-flow cooler.

16. The cooling system as claimed in claim 1, wherein the second cooler is an at least twin-path cooler.

17. The cooling system as claimed in claim 1, wherein the second cooler is a cross-flow cooler.

18. The cooling system as claimed in claim 1, further comprising a further air-cooled cooler, wherein the second cooler is configured to cool exhaust gas and the further air-cooled cooler is configured to cool charged fresh air.

19. The cooling system as claimed in claim 1, further comprising a further air-cooled cooler, wherein the second cooler is configured to cool charged fresh air and the further air-cooler cooler is configured to cool exhaust gas.

20. The cooling system as claimed in claim 1, further comprising a valve configured to selectively vary the second flow of ambient air to the second cooler.

21. The cooling system as claimed in claim 1, further comprising a bypass configured to route the flow of gas around the second cooler or around a further air-cooled cooler.

22. The cooling system as claimed in claim 1, wherein the second cooler is configured to supply a portion of the flow of gas to a vehicle interior space.

23. The cooling system as claimed in claim 1, wherein an intake of ambient air for cooling the flow of gas in the second cooler takes place outside of an engine bay of the motor vehicle.

24. The cooling system as claimed in claim 1, wherein an intake of ambient air for cooling the flow of gas in the second cooler takes place in a region of a wheel arch.

* * * * *